United States Patent [19]

Edwards

[11] 4,342,159

[45] Aug. 3, 1982

[54] METATARSAL GUARD SAFETY SHOE

[75] Inventor: Robert G. Edwards, Manchester, Mo.

[73] Assignee: Interco Incorporated, St. Louis, Mo.

[21] Appl. No.: 170,647

[22] Filed: Jul. 21, 1980

[51] Int. Cl.[3] ..... A43C 13/14

[52] U.S. Cl. ..... 36/77 R; 36/72 R

[58] Field of Search ..... 36/77 R, 72 R, 77 M

[56] References Cited

U.S. PATENT DOCUMENTS

| | | | |
|---|---|---|---|
| 2,601,162 | 6/1952 | McLaughlin | 36/77 R |
| 2,915,837 | 12/1959 | Schlecht | 36/72 R |
| 4,102,062 | 7/1978 | Adams | 36/72 R |

FOREIGN PATENT DOCUMENTS

| | | | |
|---|---|---|---|
| 522514 | 9/1953 | Belgium | 36/72 R |
| 2426727 | 12/1975 | Fed. Rep. of Germany | 36/72 R |
| 2536443 | 2/1977 | Fed. Rep. of Germany | 36/77 R |

*Primary Examiner*—James Kee Chi

*Attorney, Agent, or Firm*—Rogers, Eilers & Howell

[57] ABSTRACT

A safety shoe with a concealed metatarsal guard enclosed, with a metal toe cap, and thick padding, between the vamp and the lining at the forepart of the shoe. The guard itself is of a relatively rigid but somewhat yieldable plastic material curved and formed both longitudinally and laterally, overlying the rear part of the toe cap and with thick padding beneath it where it overlies the metatarsal area of the shoe. The guard is designed to spread upon receiving a heavy falling object and thereby distribute the load over the entire area of the guard so as to minimize damage to the foot.

6 Claims, 4 Drawing Figures

METATARSAL GUARD SAFETY SHOE

BACKGROUND OF THE INVENTION

Heretofore metatarsal guards have been made for shoes but they have mainly been disposed outside of the vamp and tongue. This made for an awkward construction for the wearer and one that was heavy looking. Efforts have been made to provide an enclosed metatarsal guard, particularly in the form of articulated metal sections riveted together so as to provide flexibility to make the shoe easier to put on the foot. These guards are relatively inefficient as they do not adequately distribute the forces of falling objects and are also subject to breaking of the rivets that hold the articulated sections together. Other enclosed guards have been of the very limited area and so incapable of distributing any force to prevent its being concentrated upon a particular part of the foot.

The objects of the present invention are to overcome all of the foregoing deficiencies and to provide a neat looking shoe that affords maximum protection to the wearer against forces applied to the metatarsal area. It is an object to provide such a guard that upon receiving such forces will tend to spread and to distribute and dissipate those forces through thick shock-absorbing padding over a substantial area of the foot and through the steel toe to some extent to prevent their being applied to the foot at all. Also it is an object to provide such a shoe with resilient undersoling so that if the forces are applied to the foot, they are further absorbed by such undersoling.

The invention will be illustrated in connection with a shoe formed with goodyear welt construction. It will be understood that it can be used with other types of safety foot coverings such as boots or shoes made with other types of shoe constructions and patterns.

IN THE DRAWINGS

BRIEF DESCRIPTION OF PREFERRED EMBODIMENT

Figure 1:
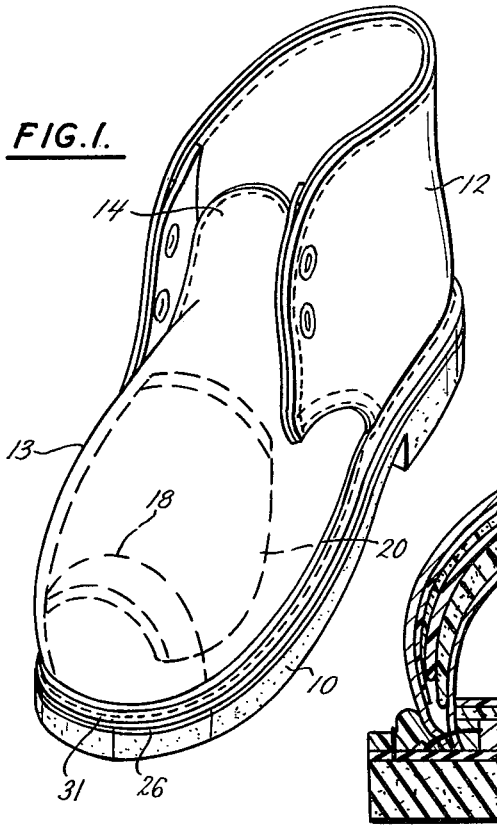
FIG. 1 is a perspective view of a safety shoe with certain parts shown in dashed lines.

The shoe is illustrated as having an outsole 10, an upper 12, a vamp 13, the vamp having an integral tongue 14. A lining 15 is located below the vamp, and its exposed edges are stitched to the vamp. Between the forepart of the vamp and lining a pocket is formed, wherein are guard elements to protect the toe and metatarsal parts of the wearer's feet.

A layer of foam-like cushion material 16, such as Selite is cemented to the under surface of the forward part of the vamp. A coating 17 of thermal plastic material is applied and adhered to the underside of the forepart of the vamp overlying the sheet 16, to give greater firmness to that part of the vamp, as will appear. Also at the forepart of the shoe, below the cushion material there is a rigid metal toe cap 18, as is known in this art.

Figure 4:
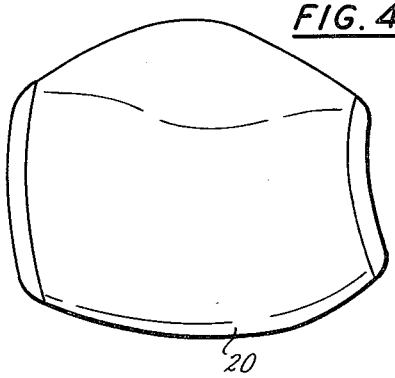
FIG. 4 is a top view of a plastic metatarsal guard insert.

A plastic, shaped, guard member 20, shown separately in FIG. 4, preferably of molded and contoured form, overlaps the back portion of the toe cap. It extends from the toe cap upwardly and backwardly to overlie the metatarsal portion of the shoe and the foot of the wearer. Below the metatarsal guard 20 there is a mass of shock-absorbing material 22, that is approximately ⅝ inch thick in its midportion.

The foam sheet 16 is cemented to the under side of the vamp 13 but is not cemented to the steel toe or to the plastic guard 20. The plastic guard 20 is made of relatively stiff but somewhat resilient plastic material such as ABS Resin, that will withstand heavy blows and dissipate the impact. It is not cemented to the steel toe but is cemented to the shock-absorbing material 22. The lining 15 is cemented to the under side of the padding 22 and the under side of the steel toe, and at its upper end, to the tongue 14.

Figure 3:
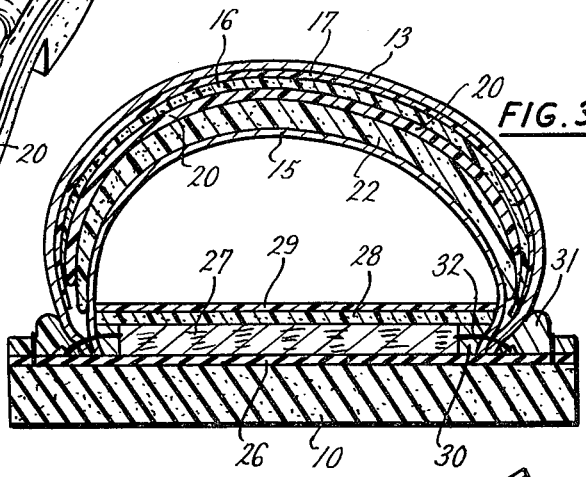
FIG. 3 is a transverse section on the line 3—3 of FIG. 2.
Figure 2:
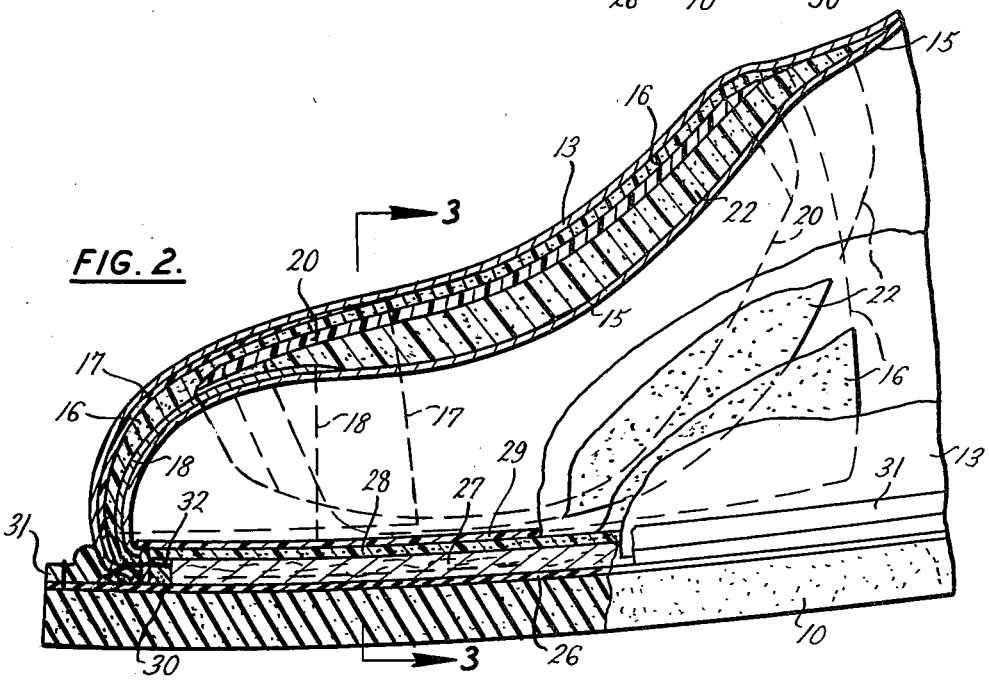
FIG. 2 is a somewhat enlarged longitudinal medial section through the forepart of the shoe.

The metatarsal guard 20 is shaped so that it can be placed within the shoe upper to overlie the metatarsal area of the wearer's foot. As shown by FIGS. 2 and 3, it curves both longitudinally and transversely. At its forward end it can ride over the metal toe cap as the tongue is lifted, to permit insertion of the foot into the shoe, or when walking. The sides of the plastic guard do not extend down to the welt. Its side edges are curved down and forward, as shown in dashed lines in FIG. 2, so as not to extend below the arch portion of the shoe. Its forward and rear edges are beveled to permit a smoother appearance to the shoe.

The thermal plastic coating 17 on the under side of the vamp over the toe cap is designed to provide a hardened surface and prevent creep of the foam material 16 that could be caused by the repeated small forward movements of the metatarsal guard 20 over the toe cap 18.

The illustrated shoe is made with a cushion insole, and a standard Goodyear welt construction. A rubber midsole 26 is inserted between the insole and the outsole 10. Above it is a urethane-cork cushion 27 on top of which is a foam cushion insole 28, covered by a blown urethane layer 29. A rib 30 usually of a drill and fibre compound is secured around the bottom edge of the insole. A welt 31 is stitched around the outsole. Stitching 32 secures the welt, vamp 15, and rib together. The outsole 10 is of cellular resilient material, containing many tiny air cells.

IN USE

The shoe can be put onto the foot and will not interfere with walking because of the ability of the upper end of the metatarsal guard 20 to yield upwardly to some degree by virtue of the movement of the forward end over the steel toe. The guard does not extend below the overhang at the arch part of the shoe.

If a heavy object falls onto the arch of the foot of the wearer of this shoe, the load is distributed over the foot in such a manner as to minimize damage to the foot. The load is transmitted to some extent down to the steel toe cap which is immediately below the forward area of the plastic guard 20. The downward force of the falling object will spread the plastic guard 20, thereby greatly increasing the area of the foot to which the force may be applied. It is thought that the spreading of the plastic guard 20 withouthaving its lower edges supported on the welt and outsole, is aided by the curvature in both longitudinal and transverse directions. The thick padding 22 aids in distribution of the force, and tends to cushion it. More cushioning effect is provided by the resilient support below the foot, including the cellular outer sole and heel, the cushion insole, and the cork.

For illustration, the material 16 can be a polyurethane such as Selite or Ensolite. The plastic of the guard 20 typically is an ABS Resin or similar material available from several sources. The material 22 is a closed cell shock-absorbing material called Ensolite.

While this material of the guard 20 has some degree of yield to it, and while the construction here provides for easily getting the shoe onto the foot, the arrangement avoids the problems attendant on articulated metal metatarsal guards that have been suggested in the past. Such articulated guards are subject to shearing of the pivots and do not distribute the load or force the same way that the present device can do.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What I claim is:

1. In a safety shoe, a sole; a firm, force-resisting toe cap; an upper attached to the sole and extending over the toe cap and the metatarsal area of the shoe; a lining layer below the upper in the metatarsal area, a unitary metatarsal guard of relatively stiff, resilient material confined between the lining and the upper to underlie the upper, the guard having sufficient resiliency to spread under impact of heavy blows upon the top of it, the guard being shaped to have its forward edge overlie the toe cap, and to extend from the toe cap upward to at least substantially overlie the metatarsal area of the shoe, and to curve downward along the sides of such area below the upper, its side edges being displaced from the sole and free of the sole so as not normally to contact the sole and to be laterally movable relatively thereto, and a padding of energy-absorbent material secured to the shoe below the metatarsal guard, the arrangement being such as to permit the guard to spread and thereby to distribute blows applied to the top of the guard over a substantial area to reduce the damaging effect thereof upon a wearer's foot.

2. In the shoe of claim 1: the end of the guard being slidable over the toe cap to facilitate bending of the shoe in use.

3. In the shoe of claim 1: and the sole being a resilient, cushion sole.

4. In the shoe of claim 1: the guard having an upwardly concave longitudinal curvature, as well as an upwardly convex transverse curvature.

5. In the shoe of claim 1: a surface hardening plastic coating on the underside of the upper at its forward end, to reduce crawl of the upper and cushion over the toe cap.

6. In the shoe of claim 1: energy absorbent type material secured to the underside of the upper and over the guard.

* * * * *